US012180704B2

(12) United States Patent
Sollie et al.

(10) Patent No.: US 12,180,704 B2
(45) Date of Patent: Dec. 31, 2024

(54) SANITARY SHIELD

(71) Applicant: Pratt Corrugated Holdings, Inc., Brookhaven, GA (US)

(72) Inventors: Greg Sollie, Sharpsburg, GA (US); Shifeng Chen, Newport News, VA (US); John Anagnostopoulos, Atlanta, GA (US); Don Joe Mikell, II, Huntsville, AL (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 821 days.

(21) Appl. No.: 17/085,911

(22) Filed: Oct. 30, 2020

(65) Prior Publication Data

US 2022/0136240 A1 May 5, 2022

(51) Int. Cl.
*E04B 2/74* (2006.01)

(52) U.S. Cl.
CPC .... *E04B 2/7425* (2013.01); *E04B 2002/7418* (2013.01)

(58) Field of Classification Search
CPC . E04B 2/7425; E04B 2002/7418; A47G 5/00; A47F 2010/065; G09F 1/06; G09F 15/0068
See application file for complete search history.

(56) References Cited

U.S. PATENT DOCUMENTS 1,486,695 A * 3/1924 Singer ..... B65D 5/5253 206/747
2,981,583 A * 4/1961 Eisenberg ..... A47F 3/142 269/97
3,326,147 A 6/1967 Toney
3,538,976 A 11/1970 Gilbert et al.
(Continued)

FOREIGN PATENT DOCUMENTS

CN 106923511 7/2017
KR 200419237 6/2006
(Continued)

OTHER PUBLICATIONS

Sollie, Greg; Notice of Allowance for U.S. Appl. No. 29/756,862, filed Oct. 30, 2020, mailed Jun. 6, 2022, 13 pgs.
(Continued)

*Primary Examiner* — Abe Massad
(74) *Attorney, Agent, or Firm* — Taylor English Duma LLP

(57) ABSTRACT

Example aspects of a sanitary shield and a method of folding a sanitary shield are disclosed. The sanitary shield can comprise a lower shield defining a upper end and a lower end, the lower shield comprising a lower center wall, a first lower sidewall angled relative to the lower center wall, and a second lower sidewall angled relative to the lower center wall, the lower end of the lower shield configured to rest on a support surface; and an upper shield coupled to the lower shield at the upper end, the upper shield comprising an upper
(Continued)

center wall, a first upper sidewall angled relative to the upper center wall, and a second upper sidewall angled relative to the upper center wall, wherein the sanitary shield is positionable in an upright configuration, each of the lower shield and upper shield oriented substantially vertical in the upright configuration.

6 Claims, 8 Drawing Sheets

(56) References Cited

U.S. PATENT DOCUMENTS

| | | | | |
|---|---|---|---|---|
| 4,949,490 | A * | 8/1990 | Miller | G09F 15/0068 40/605 |
| 5,012,832 | A | 5/1991 | Turner | |
| 5,890,782 | A * | 4/1999 | Alberts | A47B 17/00 312/258 |
| 6,012,258 | A | 1/2000 | Brown et al. | |
| 6,155,325 | A * | 12/2000 | Schirer | G09F 15/0056 160/405 |
| 6,237,668 | B1 * | 5/2001 | Hitchings | A47G 5/00 160/351 |
| 7,303,077 | B2 | 12/2007 | Harlocker | |
| RE44,673 | E * | 12/2013 | Albenda | B43L 1/00 206/745 |
| 9,920,520 | B2 | 3/2018 | Udagawa et al. | |
| D868,504 | S | 12/2019 | Lowrey et al. | |
| D873,053 | S | 1/2020 | Wolf | |
| 11,160,376 | B2 * | 11/2021 | Gass | A47B 97/00 |
| D963,380 | S | 9/2022 | Sollie et al. | |
| D972,340 | S * | 12/2022 | Schuch | D6/643 |
| D978,579 | S | 2/2023 | Sollie et al. | |
| D999,572 | S | 9/2023 | Sollie et al. | |
| 2004/0143932 | A1 | 7/2004 | Chen | |
| 2005/0183639 | A1 * | 8/2005 | O'Leary | A47B 83/001 108/60 |
| 2006/0048421 | A1 * | 3/2006 | Oleksak | G09F 15/0068 40/610 |
| 2016/0348358 | A1 | 12/2016 | Udagawa et al. | |
| 2021/0353075 | A1 | 11/2021 | Ward et al. | |

FOREIGN PATENT DOCUMENTS

| | | |
|---|---|---|
| KR | 200440401 | 6/2008 |
| KR | 1020140028690 | 3/2014 |
| KR | 200481374 | 9/2016 |
| KR | 102032188 | 2/2019 |

OTHER PUBLICATIONS

Amazon; Article entitled: "Nuomeisi Sneeze Guard", accessed on Aug. 18, 2020, 6 pgs.
Amazon; Article entitled: Portable Sneeze Guard, Clear Acrylic Plexiglass Shield Guard for Student Desk, Employers, Workers & Customers, accessed on Aug. 21, 2020, 5 pgs.
Amazon; Article entitled: "Sneeze Guard Folding Barrier or Classroom Student Desk or Counter", accessed on Aug. 21, 2020, 5 pgs.
Amazon; Article entitled: "XWU Sneeze Guard Countertop Plexiglass Shield", accessed on Aug. 21, 2020, 6 pgs.
Artfire.com; Article entitled: "Fabric Notepad holder with Velcro closure", accessed on Aug. 21, 2020, 7 pgs.
Privacyshields.com; Article entitled: "Privacy Shields (Study Carrels) 13"Height—Prevent Cheating in Class?", accessed on Aug. 18, 2020, 4 pgs.
ShoppopDisplays; Assembly Instructions for School Desk Shield, publicly available prior to Aug. 21, 2020, 2 pgs.
Sollie, Greg; Notice of Allowance for Design U.S. Appl. No. 29/848,651, filed Aug. 4, 2022, mailed Oct. 12, 2022, 6 pgs.
Sollie, Greg; Notice of Allowance for U.S. Appl. No. 29/881,841, filed Jan. 6, 2023, mailed Jul. 24, 2023, 12 pgs.

* cited by examiner

SANITARY SHIELD

TECHNICAL FIELD

This disclosure relates to sanitary devices. More specifically, this disclosure relates to a sanitary shield for shielding a user against airborne germs.

BACKGROUND

Shields can be placed on a support surface for providing privacy to a user, shielding the user from airborne germs, and various other purposes. Shields typically comprise a singular shield and are either opaque or transparent. However, users are unable to see through opaque shields, and transparent shields offer limited or no privacy. Furthermore, shields often are not sufficiently sized or shaped to block airborne germs. Some shields are foldable; however, shields may not fold to a sufficiently compact size, and typically cannot be secured in the folded configuration.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a sanitary shield comprising a lower shield defining a upper end and a lower end, the lower shield comprising a lower center wall, a first lower sidewall angled relative to the lower center wall, and a second lower sidewall angled relative to the lower center wall, the lower end of the lower shield configured to rest on a support surface; and an upper shield coupled to the lower shield at the upper end, the upper shield comprising an upper center wall, a first upper sidewall angled relative to the upper center wall, and a second upper sidewall angled relative to the upper center wall, wherein the sanitary shield is positionable in an upright configuration, each of the lower shield and upper shield oriented substantially vertical in the upright configuration.

Also disclosed is a foldable sanitary shield comprising a lower shield comprising a lower center wall, a first lower sidewall hingedly connected to the lower center wall, and a second lower sidewall hingedly connected to the lower center wall; and an upper shield coupled to the lower shield, the upper shield comprising an upper center wall, a first upper sidewall movably coupled to the upper center wall, and a second upper sidewall movably coupled to the upper center wall, wherein the foldable sanitary shield is configurable in a folded configuration and an unfolded configuration.

A method of folding a sanitary shield is also disclosed, the method comprising providing the sanitary shield comprising a lower shield and an upper shield coupled to the lower shield, the lower shield comprising a lower center wall, a first lower sidewall, and a second lower sidewall; folding a folding portion of the upper shield relative to the lower shield at a lateral fold line of the upper shield; folding the first lower sidewall relative to the lower center wall; and folding the second lower sidewall relative to the lower center wall to orient the sanitary shield in a folded configuration.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
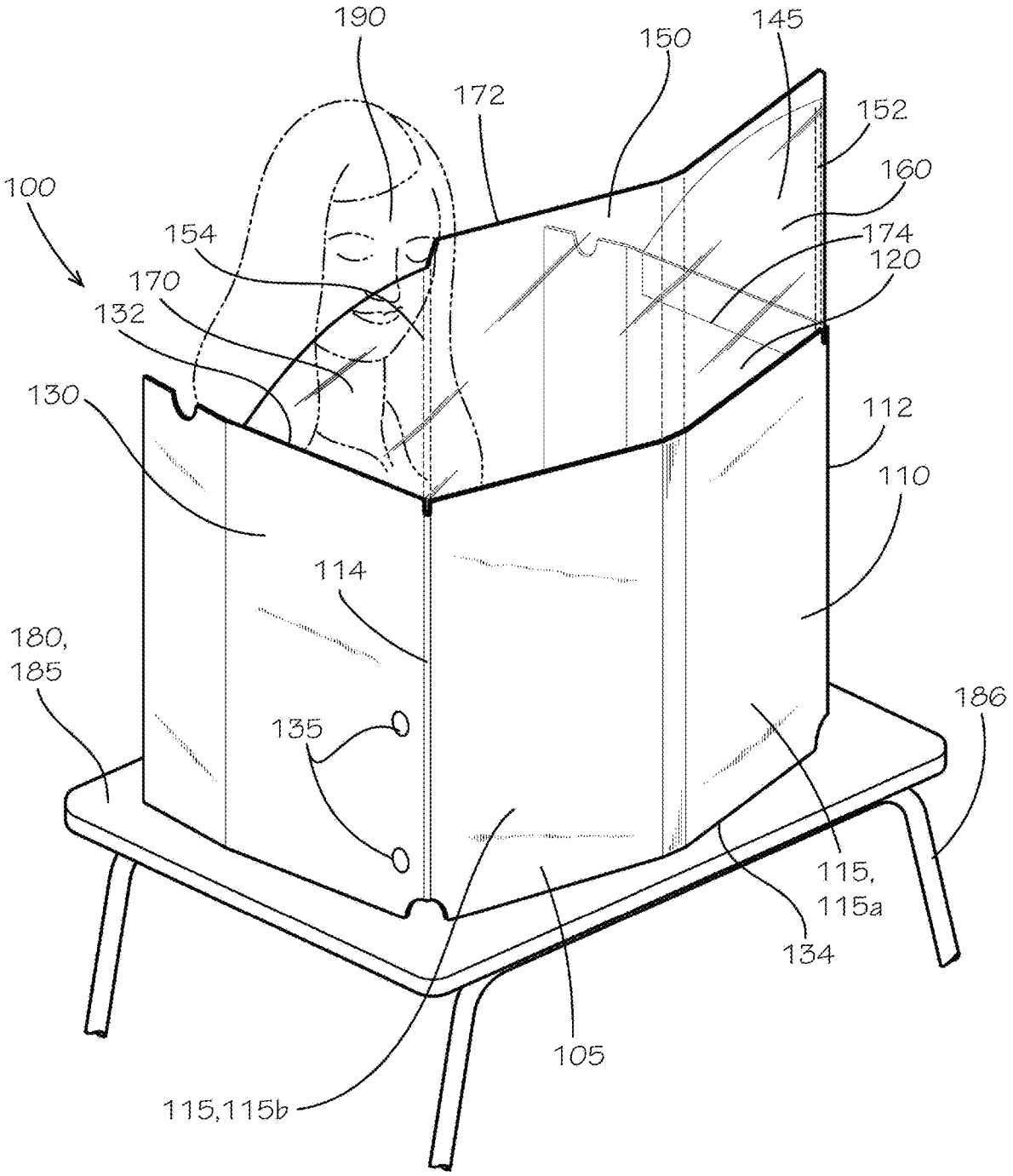
FIG. 1 is a rear perspective view of a sanitary shield, in accordance with one aspect of the present disclosure, wherein the sanitary shield is shown in an unfolded, upright configuration, the sanitary shield comprising an upper shield and a lower shield.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure.

It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a sanitary shield and associated methods, systems, devices, and various apparatus. Example aspects of the sanitary shield can comprise an upper shield and a lower shield. The sanitary shield can be configured in a folded configuration and an unfolded configuration. In some aspects, at least the upper shield can be transparent. It would be understood by one of skill in the art that the sanitary shield is described in but a few exemplary embodiments among many. No particular terminology or description should be considered limiting on the disclosure or the scope of any claims issuing therefrom.

Figure 2:
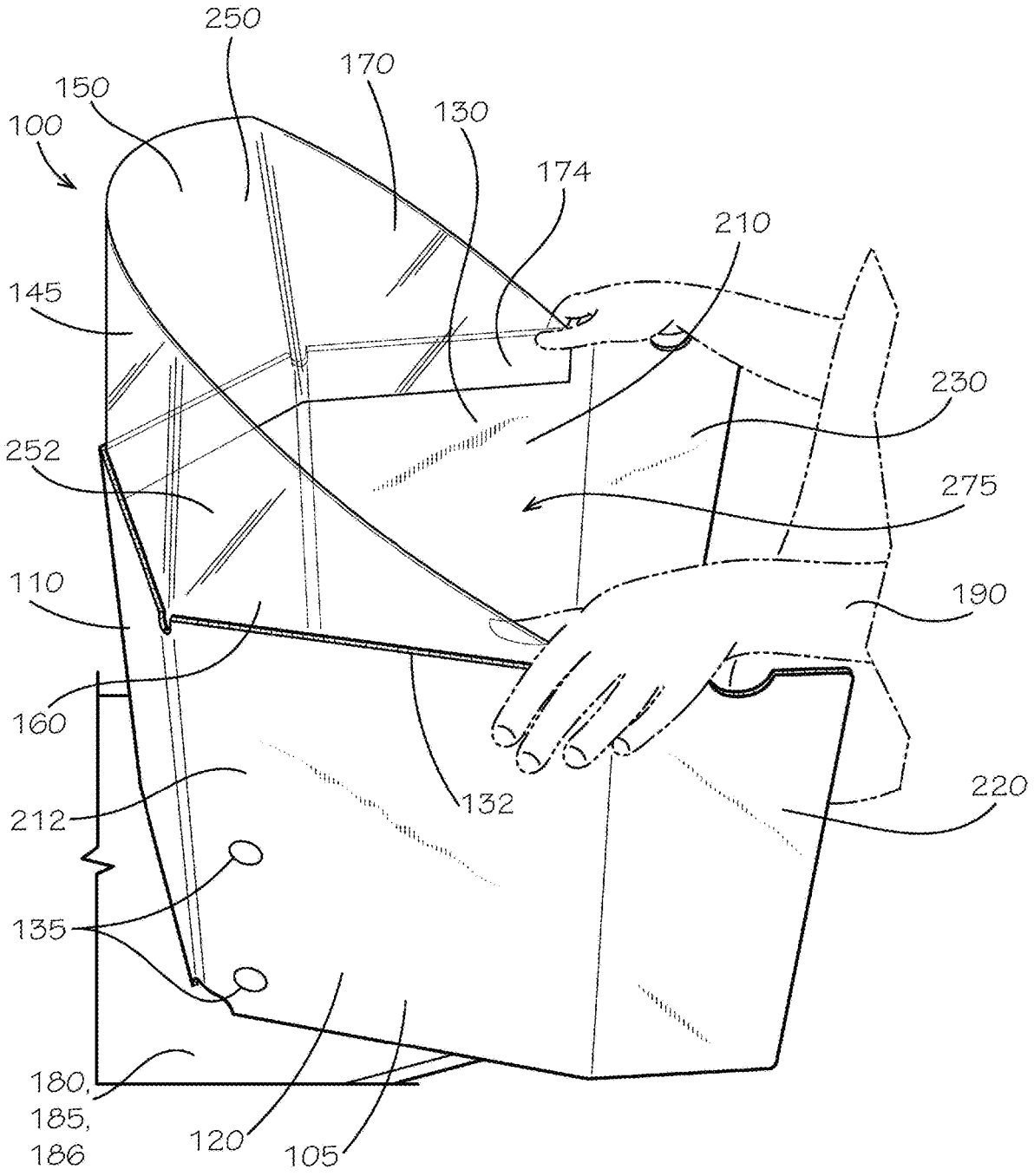
FIG. 2 is a side perspective view of the sanitary shield of FIG. 1.
Figure 7:
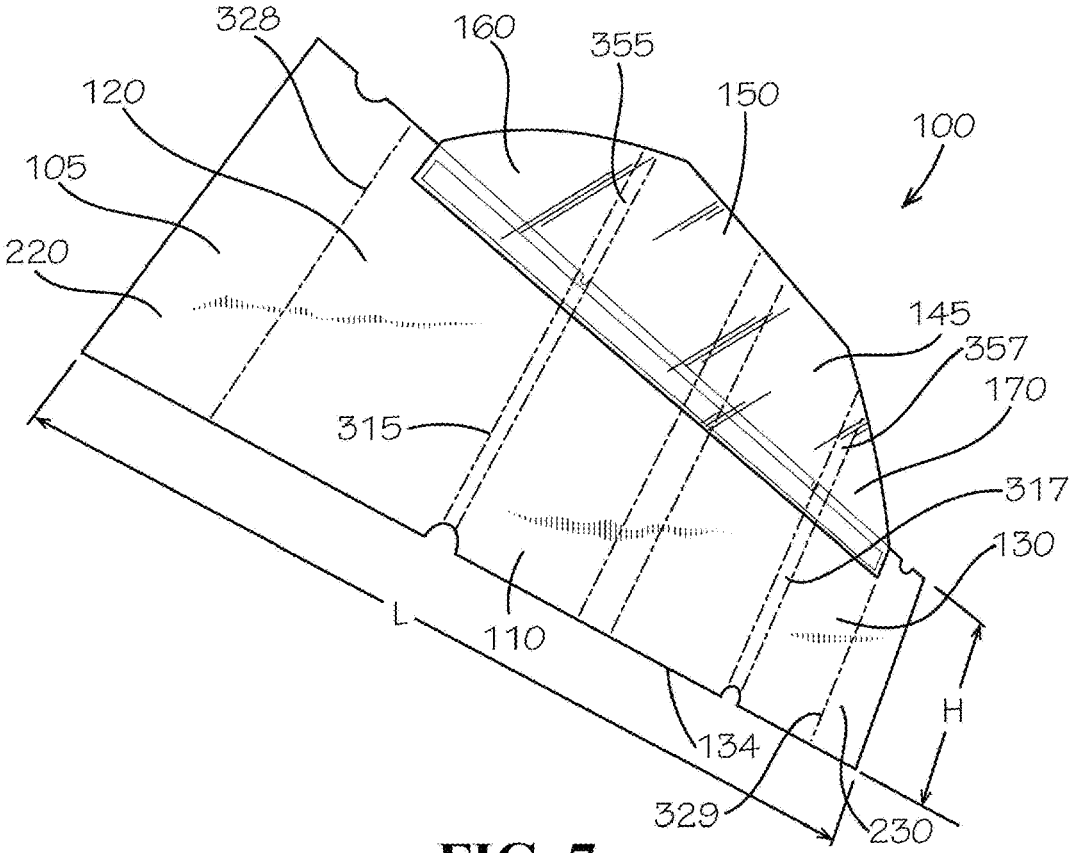
FIG. 7 is a front perspective view illustrating the sanitary shield of FIG. 1 in an unfolded, flat configuration.
Figure 12:
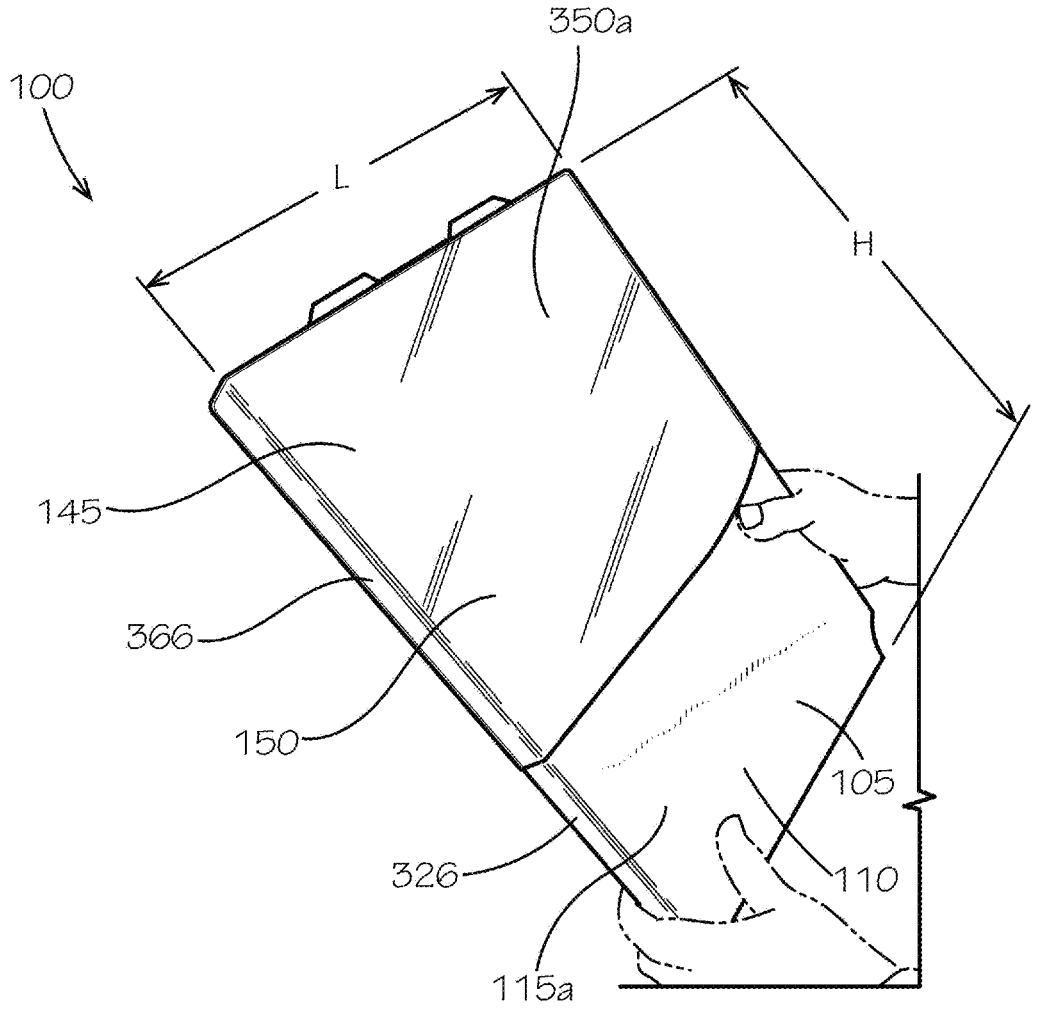
FIG. 12 is a front perspective view of the sanitary shield of FIG. 1 in a folded configuration.

FIG. 1 is a rear perspective view of a sanitary shield 100, in accordance with one aspect of the present disclosure. According to example aspects, the sanitary shield 100 can be a foldable sanitary shield 100 and can be configurable in an unfolded configuration, as shown in FIGS. 1, 2, and 7, and a folded configuration, as shown in FIG. 12. Example aspects of the sanitary shield 100 can also be configurable in an upright configuration, as shown in FIGS. 1 and 2, and a flat configuration, as shown in FIG. 7. The sanitary shield 100 can be configured to rest on a support surface 180, such as a desktop 185 of a desk 186, as shown, and can aid in shielding a user 190 from airborne germs in the upright configuration. As shown, example aspects of the sanitary shield 100 can comprise a lower shield 105 configured to rest on the support surface 180 and an upper shield 145 supported by the lower shield 105 above the support surface 180. Each of the lower shield 105 and upper shield 145 can be oriented substantially vertical in the upright configuration. In some aspects, one or both of the lower and upper shields 105, 145 can be transparent to allow the user 190 to see through the lower and/or upper shields 105, 145. For example, in the present aspect, the upper shield 145 can be transparent for visibility therethrough, and the lower shield 105 can be opaque for privacy. In some aspects, the lower shield 105 can be translucent and can still provide privacy to the user. In some aspects, either or both of the lower and upper shields 105, 145 can be opaque, transparent, or translucent.

According to example aspects, the lower shield 105 can be formed from a substantially stiff material, such as a corrugated cardboard material, such that the lower shield 105 can be capable of standing upright on the support surface 180 and supporting the upper shield 145. In other aspects, the lower shield 105 can be formed from any other suitable material or combination of materials known in the art, including but not limited to, paper, fiberboard, containerboard, plastic, composite, and the like. The lower shield 105 can comprise a lower center wall 110 defining a first side 112 and an opposite second side 114. The lower center wall 110 can define one or more lower center panels 115. For example, in the present aspect, the lower center wall 110 can define a first lower center panel 115*a* and a second lower center panel 115*b* movably connected (e.g., hingedly connected) to the first lower center panel 115*a*. The first lower center panel 115*a* can define the first side 112 of the lower center wall 110, and the second lower center panel 115*b* can define the second side 114 of the lower center wall 110. Other aspects of the lower center wall 110 can define more or fewer lower center panels 115. For example, in another aspect, the lower center wall 110 may define a singular lower center panel 115. According to example aspects, the lower shield 105 can further comprise a first lower sidewall 120 movably connected (e.g., hingedly connected) to the first lower center panel 115*a* at the first side 112 of the lower center wall 110 and a second lower sidewall 130 movably connected (e.g., hingedly connected) to the second lower center panel 115*b* at the second side 114 of the lower center wall 110. In some aspects, either or both of the first and second lower sidewalls 120, 130 can define one or more folding fasteners 135 configured to secure the sanitary shield 100 in the folded configuration, as described in further detail below.

In the unfolded, upright orientation of FIG. 1, each of the first lower sidewall 120 and second lower sidewall 130 can be angled relative to the lower center wall 110. For example, in some aspects, the first and second lower sidewalls 120, 130 can be angled at about 90° relative to the lower center wall 110. In other aspects, the first and second lower sidewalls 120, 130 can be angled at greater or less than 90° relative to the lower center wall 110. In the present example aspect, the first and second lower sidewalls 120, 130 can be angled slightly greater than 90° relative to the lower center wall 110, and the lower shield 105 can substantially define a U-shape. As shown, the lower shield 105 can further define an upper end 132 and a lower end 134 opposite the upper end 132. Each of the lower center wall 110, first lower sidewall 120, and second lower sidewall 130 can extend from the upper end 132 to the lower end 134. The lower end 134 of the lower shield 105 can be configured to rest on the support surface 180, e.g., the desktop 185, and the lower shield 105 can extend substantially upward therefrom, relative to the orientation shown. In example aspects, the upper shield 145 of the sanitary shield 100 can be secured to the lower shield 105 at or near the upper end 132 thereof, and can extend substantially upward therefrom, relative to the orientation shown.

Example aspects of the upper shield 145 can be formed from a substantially flexible material, such as a flexible plastic sheet. In other aspects, the upper shield 145 can be formed from any other suitable material or combination of materials known in the art, including but not limited to, paper, composite, any suitable plastic, and the like. The upper shield 145 can comprise an upper center wall 150 defining a first side 152 and an opposite second side 154, a first upper sidewall 160 movably connected (e.g., bendably connected) to the upper center wall 150 at the first side 152, and a second upper sidewall 170 movably connected (e.g., bendably connected) to the upper center wall 150 at the second side 154. In the present view, the first upper sidewall 160 and the first lower sidewall 120 are visible through the transparent upper center wall 150. In the unfolded, upright orientation, each of the first and second upper sidewalls 160, 170 can be angled relative to the upper center wall 150. For example, in some aspects, the first and second upper sidewalls 160, 170 can be bent at about 90° relative to the upper center wall 150. In other aspects, the first and second upper sidewalls 160, 170 can be bent at greater or less than 90° relative to the upper center wall 150. In the present example aspect, the first and second upper sidewalls 160, 170 can be bent at slightly greater than 90° relative to the lower center wall 110, and the upper shield 145 can substantially define a U-shape. Furthermore, the upper shield 145 can define an upper end 172 and a lower end 174 opposite the upper end 172. In the present view, the lower end 174 of the upper shield 145 is visible through the transparent upper center wall 150. Each of the upper center wall 150 and the first and second upper sidewalls 160, 170 can extend from the upper end 172 to the lower end 174. The lower end 174 of the upper shield 145 can be secured to the lower shield 105 at or near the upper end 132 thereof. When the upper shield 145 is assembled with the lower shield 105, the upper center wall 150 can extend substantially along a length of the lower center wall 110, the first upper sidewall 160 can extend substantially along a length of the first lower sidewall 120, and the second upper sidewall 170 can extend substantially along a length of the second lower sidewall 130. According to example aspects, the substantially U-shaped lower and upper shields 105, 145 can together define a shielded space 275 (shown in FIG. 2) that can be partially encompassed by the lower and upper shields 105, 145.

To use the sanitary shield 100, a user 190 can place the sanitary shield 100 in the upright, unfolded orientation on the support surface 180, with the lower end 134 of the lower shield 105 contacting the support surface 180. The upper center wall 150 and lower center wall 110 can be distal to the user 190, and the first and second upper and lower sidewalls 120, 130, 160, 170 can extend towards the user 190, such that the user 190 is facing towards the shielded space 275 defined by the sanitary shield 100. In some instances, the portions of the sanitary shield 100 may extend alongside the user 190, such that portions of the user 190, such as the user's face, may be fully or partially received within the shielded space 275. The sanitary shield 100 can aid in blocking external airborne germs from entering the shielded space 275, thereby protecting the user 190 from such external airborne germs. Furthermore, the sanitary shield 100 can aid in preventing airborne germs emitted by the user 190 (e.g., by sneezing or coughing) from escaping the shielded space 275, thereby protecting others from such airborne germs emitted by the user 190.

FIG. 2 illustrates a side perspective view of the sanitary shield 100 in the unfolded, upright configuration. As shown, the lower shield 105 can define a lower inner surface 210 and an opposite lower outer surface 212. Similarly, the upper shield 145 can define an upper inner surface 250 and an opposite upper outer surface 252. The inner surfaces 210, 250 of the lower and upper shields 105, 145 can face towards the user 190 and can define the shielded space 275. The outer surfaces 212, 252 of the lower and upper shields 105, 145, respectively, can face away from the user 190. In example aspects, a portion of the upper outer surface 252 at the lower end 174 the upper shield 145 can be secured to a portion of the lower inner surface 210 at the upper end 132 of the lower shield 105. For example, in the present aspect, the upper shield 145 can be secured to the lower shield 105 by an attachment fastener 410 (shown in FIG. 4), such as an adhesive strip 415 (shown in FIG. 4), as described in further detail below. In example aspects, as shown, the lower outer surface 212 of the lower shield can define indicia thereon. For example, in the present aspect, the indicia can comprise a pattern and other markings configured to resemble the outer surface of a notebook. The indicia can be printed onto the lower outer surface 212 in some aspects. Other aspects of the lower outer surface 212 can define any other indicia thereon, including images, words, patterns, and other markings. Other aspects of the lower outer surface 212 may not comprise the indicia thereon. Furthermore, in some aspects, any or all of the lower inner surface 210, upper inner surface 250, and upper outer surface 252 can also comprise indicia thereon.

In some example aspects, as shown, the lower shield 105 can define a first lower flap 220 movably connected (e.g., hingedly connected) to the first lower sidewall 120 distal to the lower center wall 110. Similarly, the lower shield 105 can define a second lower flap 230 movably connected (e.g., hingedly connected) to the second lower sidewall 130 distal to the lower center wall 110. In example aspects, the first and second lower flaps 220,230 can be configured to extend an overall length L (shown in FIG. 3) of the sanitary shield 100, thereby increasing the size of the shielded space 275 defined by the sanitary shield 100. The first and second lower flaps 220,230 can be oriented such that they are substantially planar with the first and second lower sidewalls 120, 130, respectively, or can be pivoted relative to the first and second lower sidewalls 120, 130, as desired. For example, as shown in the present aspect, each of the first and second lower flaps 220,230 can pivoted slightly inward relative to the first and second lower sidewalls 120, 130 towards the shielded space 275. In a particular example aspect, the first and second lower flaps 220,230 may be oriented at about 165° relative to the corresponding first and second lower sidewalls 120, 130. In other aspects, the first and second lower flaps 220,230 can be oriented at greater or less than 165° relative to the corresponding first and second lower sidewalls 120, 130. In some aspects, the first and second lower flaps 220,230 can be configured to extend beyond an edge of the support surface 180 (e.g., the desktop 185), such that the shielded space 275 can also extend beyond the support surface 180. For example, the first and second lower flaps 220,230 can extend beyond the edge of the support surface 180 and alongside a user 190 positioned at or near the edge of the support surface 180 (e.g., a student seated at the desk 186). In other aspects, the first and second lower flaps 220,230 may be supported on the support surface 180. In still other aspects, the lower shield 105 may not comprise the first and second lower flaps 220,230.

Figure 3:
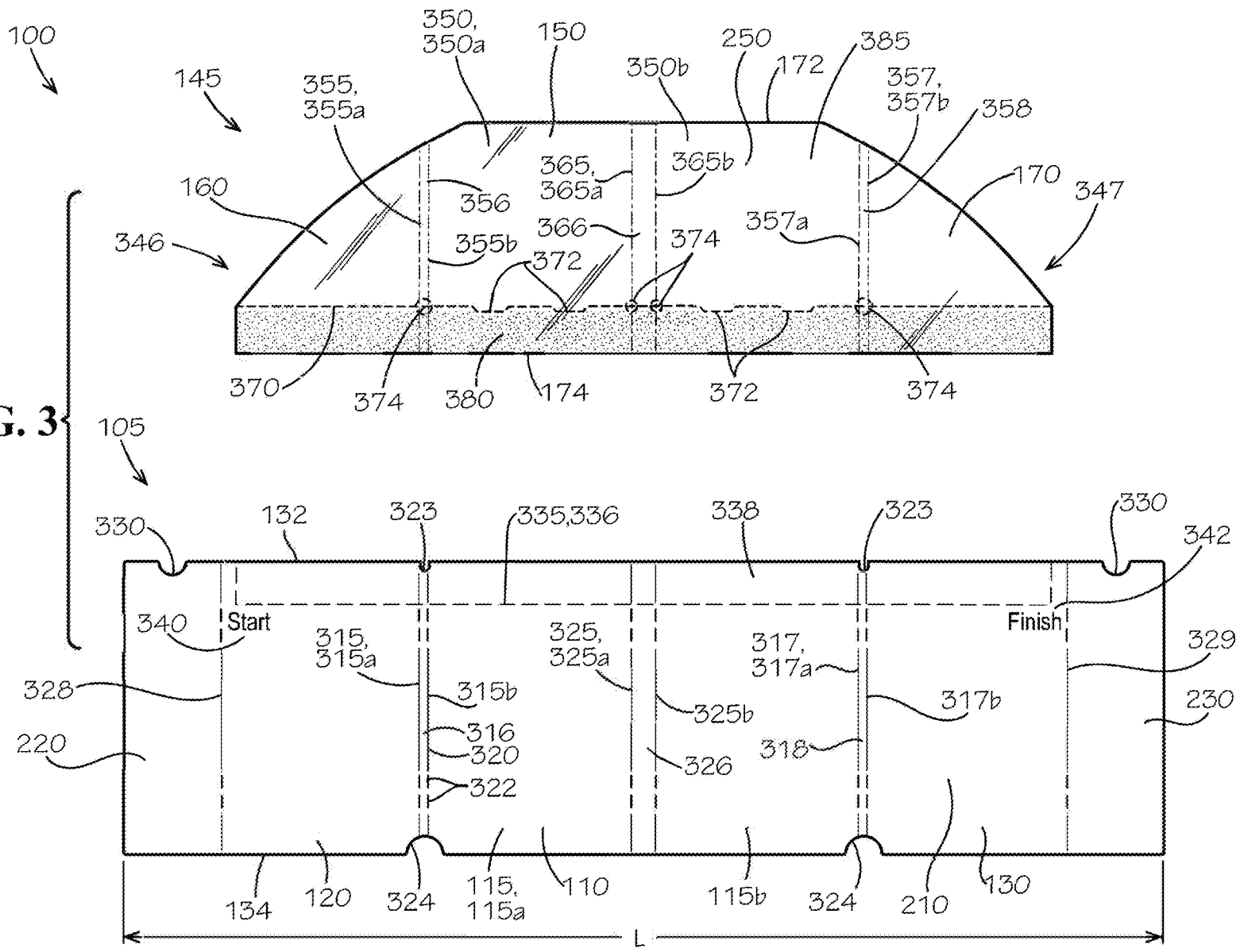
FIG. 3 is a front view of the sanitary shield of FIG. 1, wherein the upper shield is detached from the lower shield, and each of the upper and lower shields are in blank form.

FIG. 3 illustrates each of the upper shield 145 and lower shield 105 in blank form and detached from one from another. In example aspects, each of the upper shield 145 and the lower shield 105 can be formed as a unitary blank. As shown, the lower shield 105 can comprise the lower center wall 110, the first lower sidewall 120, and the second lower sidewall 130. The lower center wall 110 can define the first lower center panel 115*a* and the second lower center panel 115*b* in the present aspect; however, other aspects can define more or fewer lower center panels 115. According to example aspects, the first lower sidewall 120 can be hingedly coupled to the first lower center panel 115*a* by a first lower bend line 315, and the second lower sidewall 130 can be hingedly coupled to the second lower center panel 115*b* by a second lower bend line 317. In other aspects, the first and second lower sidewalls 120, 130 can be bendably connected or otherwise movably to the lower center wall 110. In some aspects, each of the first and second lower bend lines 315,317 can define a singular bend line. However, in other example aspects, as shown, the first lower bend line 315 can define a pair of parallel first lower bend lines 315*a,b* and a narrow first connecting piece 316 extending therebetween. Similarly, the second lower bend line 317 can define a pair of parallel second lower bend lines 317*a,b*, a narrow second connecting piece 318 extending therebetween. In example aspects, each of the parallel first and second lower bend lines 315*a,b* & 317*a,b* can be formed by a crease 320 and scoring 322 along the crease 320, which can be referred to as a cut and crease line. Other aspects of the parallel first and second lower bend lines 315*a,b* & 317*a,b* can be formed by a crease only, scoring only, perforations, or any other suitable technique for forming bend lines. In some example aspects, as shown, an upper cut-out 323 can be formed in the upper end 132 of the lower shield 105 at each of the first and second lower bend lines 315,317 and a lower cut-out 324 can be formed in the lower end 134 of the lower shield 105 at each of the first and second lower bend lines 315,317. The upper and lower cut-outs 323,324 may aid in facilitating folding the first and second lower sidewalls 120, 130 relative to the lower center wall 110 at the first and second lower bend lines 315,317, respectively. Additionally, the upper and/or lower cut-outs 323,324 can allow for the passage of various objects therethrough. The objects may include, but are not limited to, power cords for example. In a particular aspect, a power cord can pass through one of the lower cut-outs 324 for plugging into a laptop or other powered device oriented on the desktop 185 (shown in FIG. 1) within the shielded space 275 (shown in FIG. 2).

Moreover, the first lower center panel 115*a* can be hingedly coupled to the second lower center panel 115*b* by one or more lower center bend lines 325. In example aspects, the lower shield 105 can comprise a pair of the lower center bend lines 325*a,b*, which can define a lower spine 326 of the lower center wall 110 therebetween. Thus, the first lower center panel 115*a* can be hingedly coupled to the lower spine 326 by the lower center bend line 325*a* and the second lower center panel 115*b* can be hingedly coupled to the lower spine 326 by the lower center bend line 325*b*. In the present aspect, each of the lower center bend lines 325 can be a cut and crease line, as described above. Other aspects of the lower center bend lines 325 can be formed by any other suitable technique for forming bend lines. Additionally, other aspects of the lower center wall 110 can define more or fewer lower center bend lines 325 and may or may not define the lower spine 326. For example, in another aspect, the lower center wall 110 can define a single lower center bend line 325 hingedly connecting the first lower center panel 115*a* to the second lower center panel 115*b* and does not define the lower spine 326.

According to example aspects, the first lower flap 220 can be hingedly coupled to the first lower sidewall 120 by a first flap bend line 328, and the second lower flap 230 can be hingedly coupled to the second lower sidewall 130 by a second flap bend line 329. In the present aspect, each of the first and second flap bend lines 328,329 can define a singular bend line, though in other aspects, the first and second flap bend lines 328,329 can define additional bend lines. As shown, each of the first and second flap bend lines 328,329 can be a cut and crease line, though other aspects of the first and second flap bend lines 328,329 can be formed by any other suitable technique for forming bend lines. In some aspects, as shown, a flap cut-out 330 can be formed at the upper end 132 of the lower shield 105 along each of the first and second lower flaps 220,230. In example aspects, the flap cut-outs 330 can serve as a hanger for various types of objects, including but not limited to, a face mask or face shield. For example, in a particular aspect, a strap of a face mask can engage a one of the flap cut-outs 330 to hang the face mask from the sanitary shield 100.

According to example aspects, each of the first lower center panel 115*a*, second lower center panel 115*b*, first lower sidewall 120, and second lower sidewall 130 can be about equal or substantially similar in length. For example, in a particular aspect, each of the first and second lower center panels 115*a,b* can define a length of about 9.6875", and each of the first and second lower sidewalls 120, 130 can define a length of about 9.5". Furthermore, each of the first and second lower flaps 220,230 can define a length that can be lesser than the lengths of the first and second lower center panels 115*a,b* and the first and second lower sidewalls 120, 130. For example, in a particular aspect, the length of each of the first and second lower flaps 220,230 can be about 4.625". In other aspects, the lower panel 105 can define any other suitable dimensions.

As shown, in some aspects, an attachment indicator 335 can extend substantially across the first lower sidewall 120, the lower center wall 110, and the second lower sidewall 130 and can generally define an attachment area 338 of the lower shield 105 proximate to the upper end 132 thereof. The attachment indicator 335 can indicate a preferred placement location for the adhesive strip 415 (shown in FIG. 4). In the present aspect, the attachment indicator 335 can be formed as a dashed line 336 substantially outlining the attachment area 338. In other aspects, the attachment indicator 335 can define any other suitable configuration. Furthermore, in some aspects, additional or alternative indicia, such as images or words may also be provided for indicating how or where to locate the adhesive strip 415. For example, as shown, in a particular aspect, the word "Start" 340 can be printed on the first lower sidewall 120 to indicate generally where to place a first end 416 (shown in FIG. 4) of the adhesive strip 415, and the word "Finish" 342 can be printed on the second lower sidewall 130 to indicate generally where to place a second end 418 (shown in FIG. 4) of the adhesive strip 415. In other aspects, any other suitable indicia can be used to indicate how to where to locate the adhesive strip 415.

As shown, example aspects of the upper shield 145 can comprise the upper center wall 150, the first upper sidewall 160, and the second upper sidewall 170. The upper shield 145 can further define the upper end 172, the lower end 174, a first lateral side 346, and a second lateral side 347. The upper center wall 150 can define one or more upper center sections 350. For example, in the present aspect, the upper center wall 150 can define a first upper center section 350*a* and a second upper center section 350*b*. Other aspects can define more or fewer upper center sections 350. According to example aspects, the first upper sidewall 160 can be movably connected to the first upper center section 350*a* at a first upper bend line 355, and the second upper sidewall 170 can be movably connected to the second upper center section 350*b* at a second upper bend line 357. For example, the first upper sidewall 160 can be configured to bend relative to the first upper center section 350*a* at the first upper bend line 355, and the second upper sidewall 170 can be configured to bend relative to the second upper center section 350*b* at the second upper bend line 357. In other aspects, the first and second upper sidewalls 160, 170 may be pivotably, hingedly, or otherwise movably connected to the upper center wall 150. In some aspects, each of the first and second upper bend lines 355,357 can define a singular bend line. However, in other example aspects, as shown, the first upper bend line 355 can define a pair of parallel first upper bend lines 355*a,b* and a narrow first connecting strip 356 extending therebetween. Similarly, the second upper bend line 357 can define a pair of parallel second upper bend lines 357*a,b* and a narrow second connecting strip 358 extending therebetween. In the present aspect, each of the parallel first and second upper bend lines 355*a,b* & 357*a,b* can be formed as cut and crease lines. Other aspects of the parallel first and second upper bend lines 355*a,b* & 357*a,b* can be formed by any other suitable technique known in the art for forming bend lines.

According to example aspects, the first upper center section 350*a* can be movably coupled to the second upper center section 350*b* by one or more upper center bend lines 365. In example aspects, the upper shield 145 can comprise a pair of the upper center bend lines 365*a,b*, which can define an upper spine 366 therebetween. Thus, the first upper center section 350*a* can be movably connected (e.g., bendably connected) to the upper spine 366 by the upper center bend line 365*a* and the second upper center section 350*b* can be movably connected (e.g., bendably connected) to the upper spine 366 by the upper center bend line 365*b*. For example, the first upper center section 350*a* can be bent relative to the upper spine 366 at the upper center bend line 365*a* and the second upper center section 350*b* can be bent relative to the upper spine 366 at the upper center bend line 365*b* when the sanitary shield 100 is folded to the folded configuration. In the present aspect, each of the upper center bend lines 365*a,b* can be formed as a cut and crease line, as described above. Other aspects of the upper center bend lines 365 can be formed by any other suitable technique for forming bend lines. Additionally, other aspects of the upper center wall 150 can define more or fewer upper center bend lines 365 and may or may not define the upper spine 366. For example, in another aspect, the upper center wall 150 can define a single upper center bend line 365 hingedly connecting the first upper center section 350*a* to the second upper center section 350*b* and does not define the upper spine 366.

In example aspects, a lateral fold line 370 can extend across each of the first upper sidewall 160, upper center wall 150, and the second upper sidewall 170, substantially parallel with and proximate to the lower end 174 of the upper shield 145. In the present aspect, the lateral fold line 370 can be formed as a cut and crease line. In other aspects, the lateral fold line 370 can be formed by creasing only, scoring only, perforations, or any other suitable technique for forming a fold line. According to example aspects, a coupling portion 380 of the upper shield 145 can be defined generally between the lower end 174 and the lateral fold line 370, and a folding portion 385 of the upper shield 145 can be defined generally between the upper end 172 the lateral fold line 370. The folding portion 385 can be configured to fold relative to the coupling portion 380 along the lateral fold line 370, as described in further detail below. In some aspects, one or more slits 372 or other punctures can be formed substantially along the lateral fold line 370 to further facilitate folding along the lateral fold line 370. Additionally, as shown, in some aspects, a hole 374 or other puncture may be formed at the intersection of the lateral fold line 370 with each of the first upper bend line 355, second upper bend line 357, and upper center bend line 365. The holes 374 can be configured to prevent tearing at the corresponding intersection. In example aspects, as shown, the upper end 172 of the upper shield 145 can taper towards the lateral fold line 370 generally at the first and second lateral sides 346,347 thereof. In other aspects, however, the upper end 172 of the upper shield 145 may not taper at the first and second lateral sides 346,347.

When the upper shield 145 is assembled with the lower shield 105, the coupling portion 380 of the upper shield 145 can overlay the attachment area 338 of the lower shield 105, and the adhesive strip 415 can be oriented therebetween to secure the upper shield 145 to the lower shield 105. The lateral fold line 370 can be oriented substantially at or slightly above the upper end 132 of the lower shield 105, relative to the orientation shown. Additionally, when the upper shield 145 is assembled with the lower shield 105, the first upper sidewall 160 can be substantially longitudinally aligned with the first lower sidewall 120, the second upper sidewall 170 can be substantially longitudinally aligned with the second lower sidewall 130, and the upper center wall 150 can be substantially longitudinally aligned with the lower center wall 110. Thus, the first upper bend line 355, second upper bend line 357, and upper center bend line 365 can be substantially longitudinally aligned with the first lower bend line 315, second lower bend line 317, and lower center bend line 325, respectively.

Figure 4:
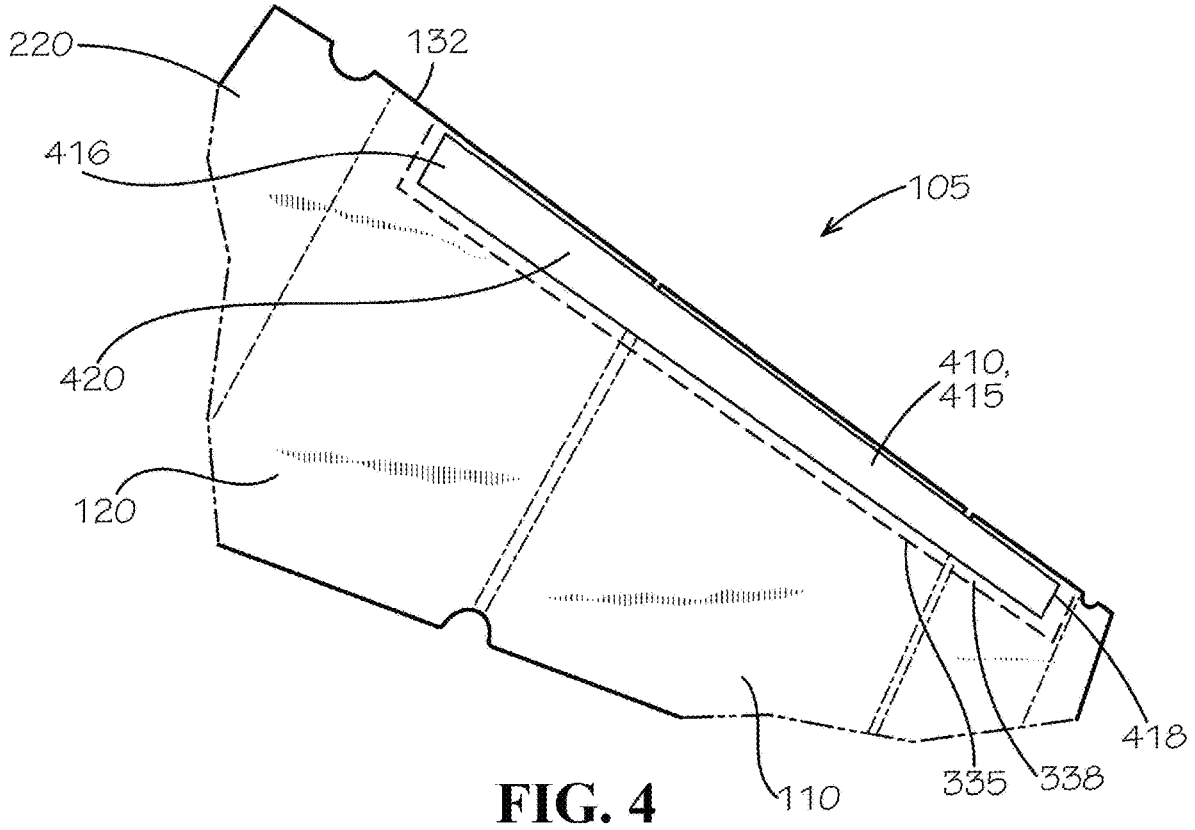
FIG. 4 is a front perspective view of the lower shield of FIG. 1 in an unfolded, flat configuration, illustrating a first step in assembling the sanitary shield of FIG. 1.
Figure 5:
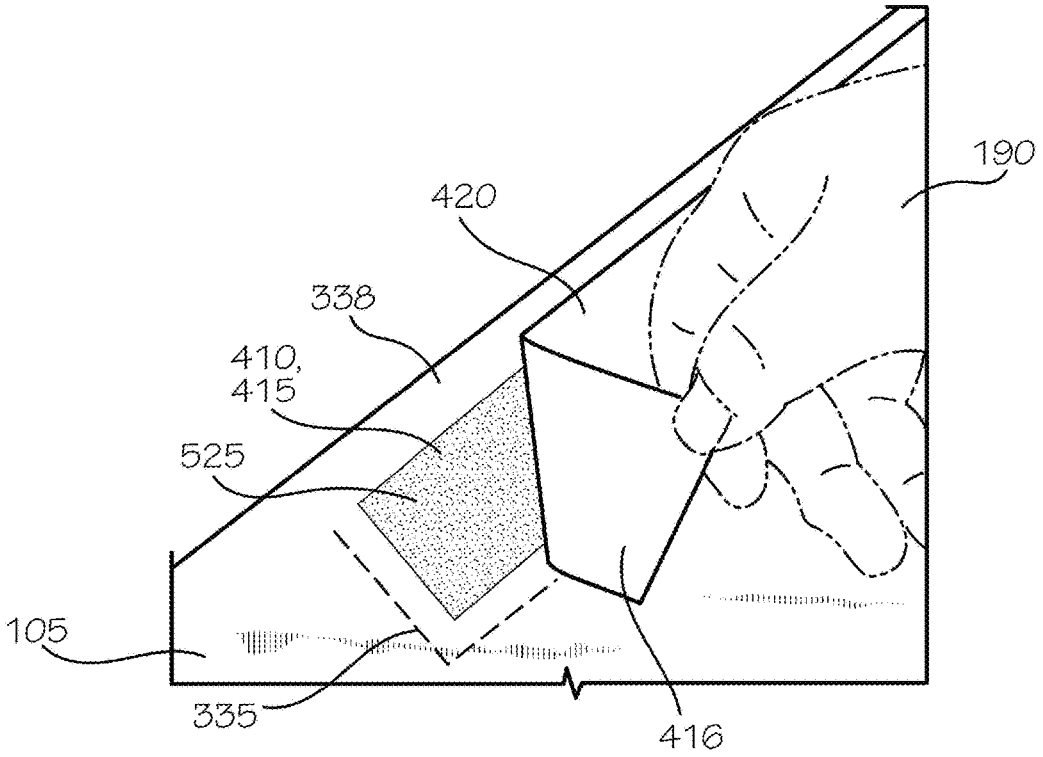
FIG. 5 is a front perspective view illustrating a second step in assembling the sanitary shield of FIG. 1.

FIG. 4 illustrates a first step in assembly the upper shield 145 (shown in FIG. 3) with the lower shield 105. As shown, the attachment fastener 410, which can be the adhesive strip 415 in the present aspect, can be applied to the attachment area 338 of the lower shield 105. The adhesive strip 415 can be double-sided and can comprise any suitable type of adhesive, such as glue, tape, or the like. Furthermore, in other aspects, the attachment fastener 410 may not be formed as a strip. In other aspects, the attachment fastener 410 can comprise any other suitable fastener or joining technique known in the art, such as, for example, staples, clips, snaps, welding, or the like. The attachment area 338 can be defined by the attachment indicator 335 proximate to the upper end 132 of the lower shield 105. Example aspects of the adhesive strip 415 can comprise a backing 420 configured to cover an adhesive 525 (shown in FIG. 5) of the adhesive strip 415 until the backing 420 is removed. FIG. 5 illustrates a user 190 removing the backing 420 to reveal the adhesive 525, which can remain adhered to the lower shield 105 at the attachment area 338. The backing 420 can be removed from the adhesive strip 415, by peeling the backing 420 away from the adhesive 525 along a length of the adhesive strip 415. The user 190 can begin peeling the backing 420 away from the adhesive 525 at either the first end 416 of the adhesive strip 415, as shown, or at the opposite second end 418 (shown in FIG. 4) of the adhesive strip 415.

Figure 6:
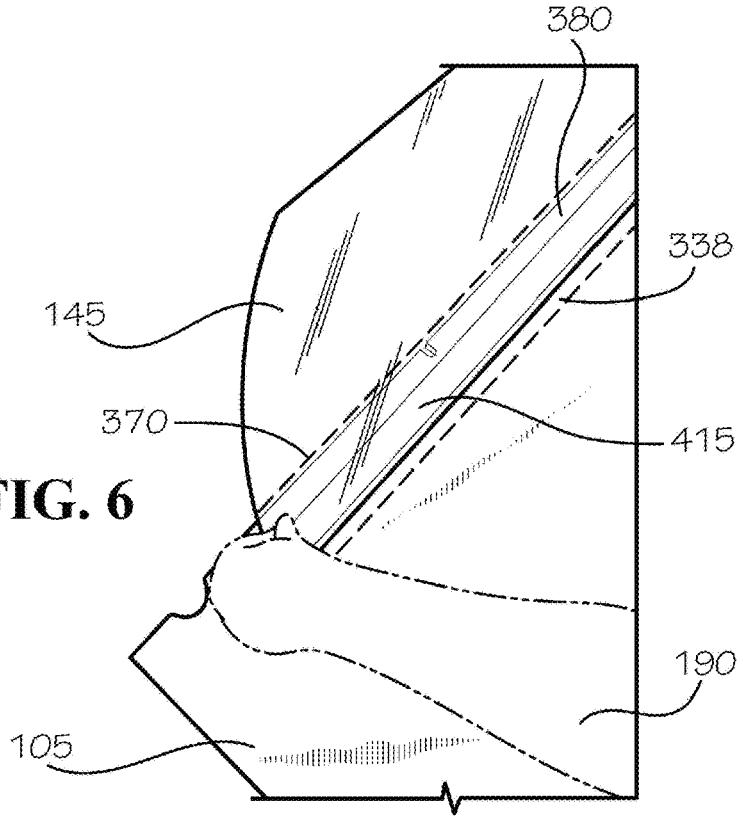
FIG. 6 is a front perspective view illustrating a third step in assembly the sanitary shield of FIG. 1.

FIG. 6 illustrates a user 190 securing the upper shield 145 to the lower shield 105 with the adhesive strip 415. As shown, the coupling portion 380 of upper shield 145 can be placed over and pressed against the attachment area 338 of the lower shield 105. The adhesive strip 415, which is already adhered to the lower shield 105 at the attachment area 338, can be adhered to the coupling portion 380 of the upper shield 145 to attach the upper shield 145 to the lower shield 105.

FIG. 7 illustrates the upper shield 145 secured to the lower shield 105 to define the sanitary shield 100. The sanitary shield 100 is illustrated in the flat, unfolded configuration, and can define the length L and a height H. To orient the sanitary shield 100 in the upright, unfolded configuration shown in FIGS. 1 and 2, the user 190 (shown in FIG. 1) can rest the lower end 134 of the lower shield 105 on the support surface 180 (shown in FIG. 1), with the sanitary shield 100 extending substantially upward therefrom. Each of the first and second lower sidewalls 120, 130 can be pivoted towards the user 190 relative to the lower center wall 110 at the corresponding first and second lower bend lines 315,317, such that the sanitary shield 100 can define the shielded space 275 (shown in FIG. 1) and can stand upright on the support surface 180 without support from the user 190. As the first and second lower sidewalls 120, 130 are pivoted relative to the lower center wall 110, the first and second upper sidewalls 160, 170 of the upper shield 145 attached thereto can bend relative to the upper center wall 150 at the corresponding first and second upper bend lines 355,357. In some instances, as described above, the user 190 can also pivot the first and second lower flaps 220,230 relative to the corresponding first and second lower sidewalls 120, 130, respectively, at the first and second flap bend lines 328,329. The first and second lower flaps 220,230 can be pivoted towards or away from the shielded space 275, as desired.

Figure 8:
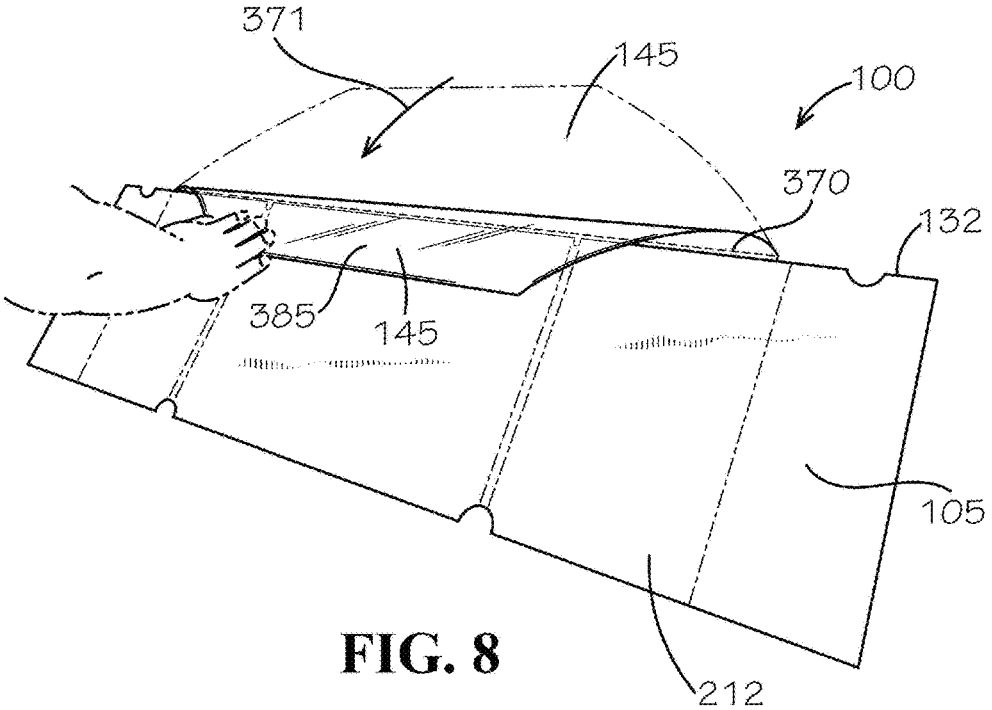
FIG. 8 is a rear perspective view illustrating a first step in folding the sanitary shield of FIG. 1.

FIG. 8 illustrates a first step in folding the sanitary shield 100 from the unfolded configuration to the folded configuration, according to example aspects. As shown, the folding portion 385 of the upper shield 145 can be folded relative to the coupling portion 380 (shown in FIG. 3) at the lateral fold line 370. The folding portion 385 can be folded over the upper end 132 of the lower shield 105 and can be configured to lie substantially flat against the lower outer surface 212 of the lower shield 105. In other aspects, the folding portion 385 may be folded to lie substantially flat against the lower inner surface 210 of the lower shield 105. As described above, the lateral fold line 370 can be a cut and crease line, which can comprise scoring 322 (shown in FIG. 3) formed along the corresponding crease 320 (shown in FIG. 3). The scoring 322, along with the slits 372 (shown in FIG. 3) and holes 374 (shown in FIG. 3) formed along the lateral fold line 370, can facilitate folding the folding portion 385 relative to the coupling portion 380 at the lateral fold line 370. The folding motion 371 is shown using an arrow.

Figure 9:
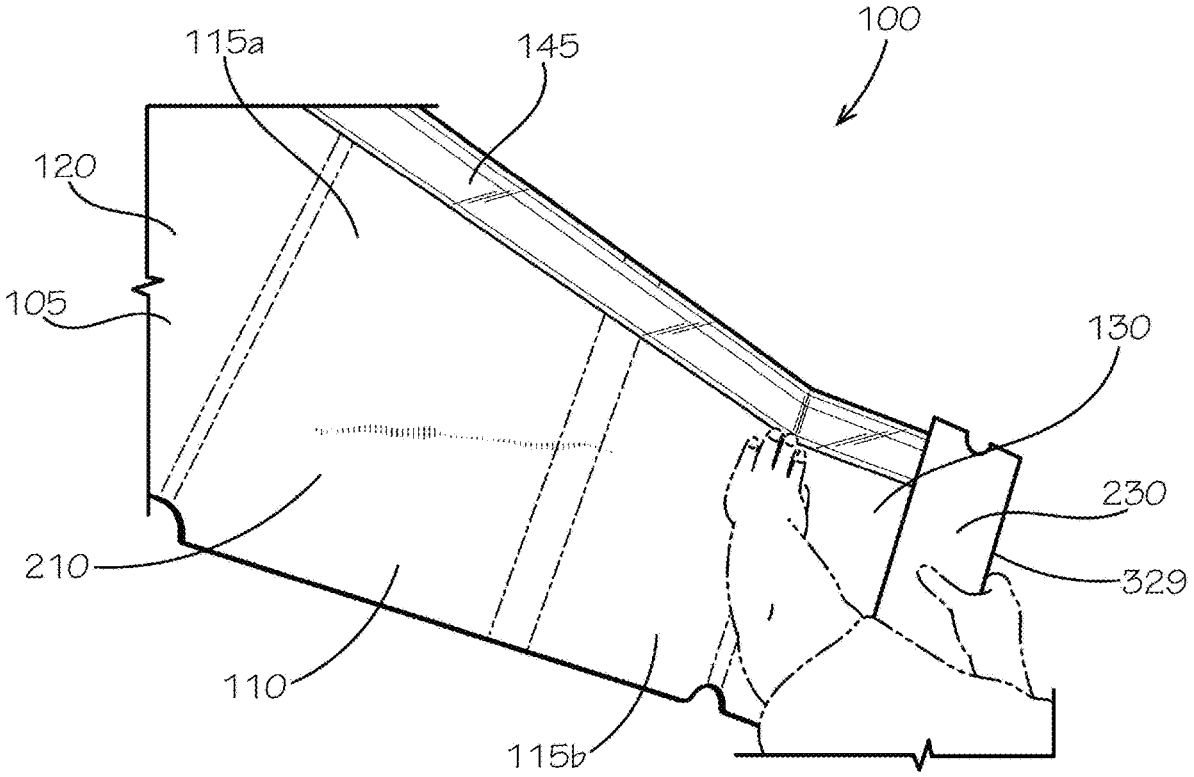
FIG. 9 is a front perspective view illustrating a second step in folding the sanitary shield of FIG. 1.

FIG. 9 illustrates a second step in folding the sanitary shield 100. According to example aspects, each of the first and second lower flaps 220,230 (first lower flap 220 shown in FIG. 2) can be folded relative to the first and second lower sidewalls 120, 130, respectively, at the first and second flap bend lines 328,329, respectively (first flap bend line 328 shown in FIG. 3). The first and second lower flaps 220,230 can be folded towards the lower inner surface 210 of the lower shield 105, such that the lower inner surface 210 at the first and second lower flaps 220,230 can substantially confront the lower inner surface 210 at the first and second lower sidewalls 120, 130. In example aspects, the first and second lower flaps 220,230 can be configured to lie substantially flat against the corresponding first and second lower sidewalls 120, 130.

Figure 10:
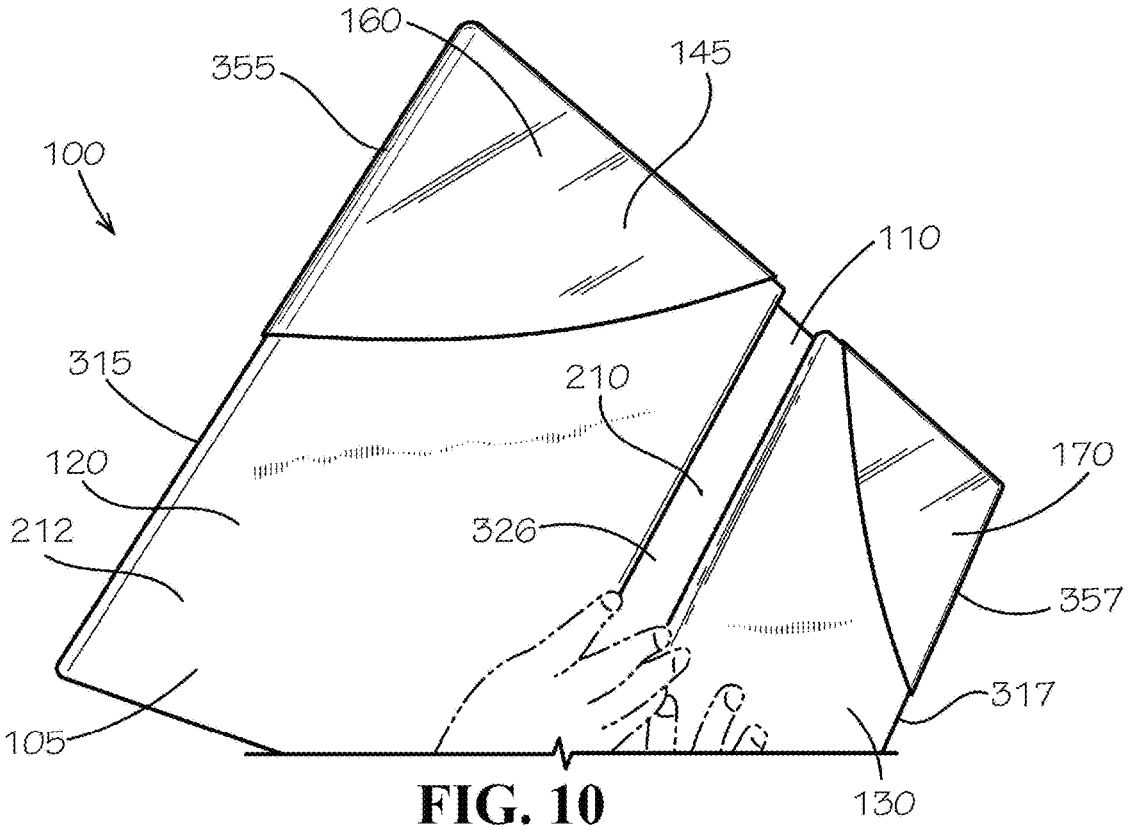
FIG. 10 is a front perspective view illustrating a third step in folding the sanitary shield of FIG. 1.

FIG. 10 illustrates another step in folding the sanitary shield 100. According to example aspects, each of the first and second lower sidewalls 120, 130 can be folded relative to the lower center wall 110 at the corresponding first and second lower bend lines 315,317, respectively. The first and second lower sidewalls 120, 130 can be folded towards the lower inner surface 210 of the lower shield 105, such that the lower inner surface 210 at the first and second lower sidewalls 120, 130 can substantially face the lower inner surface 210 at the first and second lower center panels 115*a,b* (shown in FIG. 9), respectively, of the lower center wall 110. Moreover, as the first and second lower sidewalls 120, 130 are folded at the first and second lower bend lines 315,317, the first and second upper sidewalls 160, 170 of the upper shield 145 can be bent at the first and second upper bend lines 355,357 to fold the first and second upper sidewalls 160, 170 towards the lower inner surface 210 of the lower shield 105. In this configuration, the first lower flap 220 (shown in FIG. 7) can be oriented between the first lower sidewall 120 and the first lower center panel 115*a*, and the second lower flap 230 (shown in FIG. 7) can be oriented between the second lower sidewall 130 and the second lower center panel 115*b*. As such, the first and second lower sidewalls 120, 130 may not lie directly against the lower center wall 110, but can face and be oriented substantially parallel therewith. According to example aspects, as shown, the lower spine 326 extending between the first and second lower center panels 115*a,b* can be uncovered at this step and can substantially span the distance between the first and second lower sidewalls 120, 130.

Figure 11:
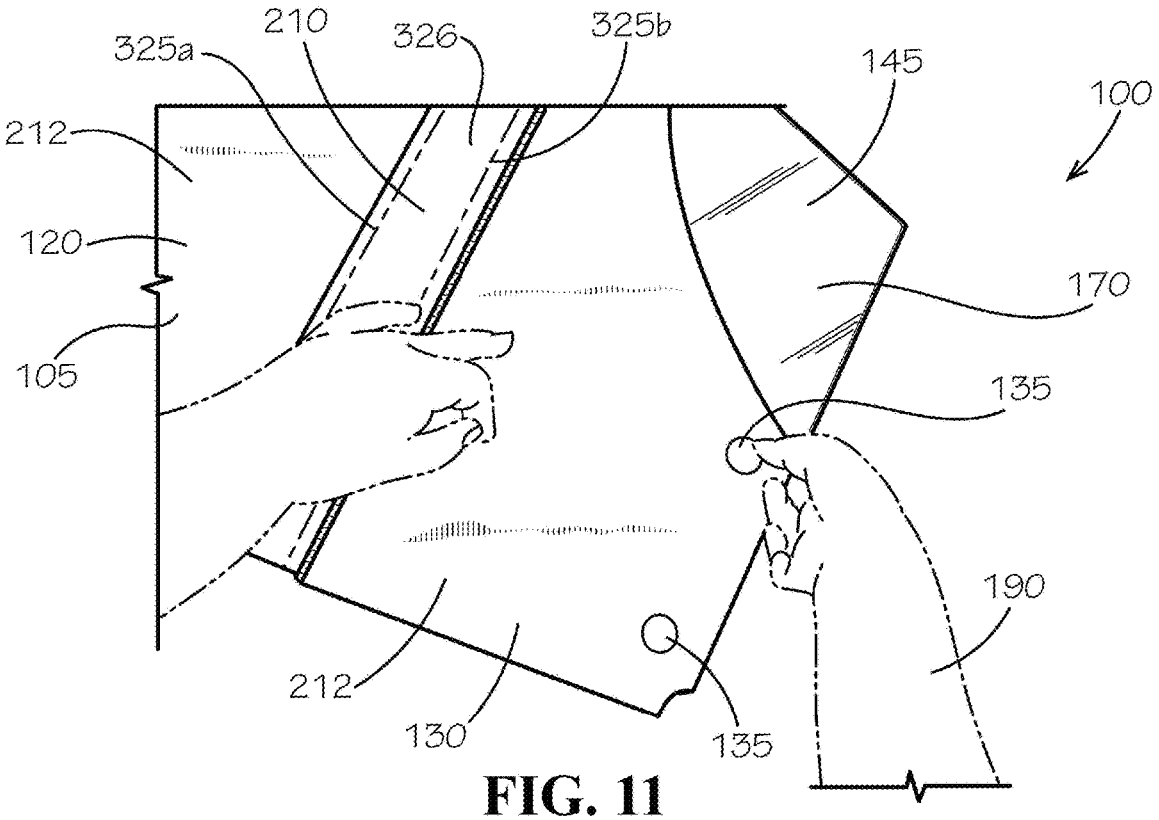
FIG. 11 is a front perspective view illustrating a fourth step in folding the sanitary shield of FIG. 1.

FIG. 11 illustrates another example step in folding the sanitary shield 100, wherein a user 190 can attach one or more of the folding fasteners 135 to the first and/or second lower sidewalls 120, 130. This step can be performed before, during, or after assembling the sanitary shield 100, or before or during folding the sanitary shield 100. In other aspects, the sanitary shield 100 may not comprise the folding fasteners 135. In the present aspect, the folding fasteners 135 can be hook and look fasteners, though in other aspects, the folding fasteners 135 can be any other suitable type of fastener known in the art, including, for example, adhesives, snaps, magnets, or the like. Furthermore, in the present aspect, at least one of the folding fasteners 135 can be secured to the first lower sidewall 120 on the lower outer surface 212 and at least a mating one of the folding fasteners 135 can be secured to the second lower sidewall 130 on the lower outer surface 212. The folding fastener 135 on the first lower sidewall 120 can be configured to releasably engage the mating folding fastener 135 on the second lower sidewall 130 to selectively secure the sanitary shield 100 in the folded configuration. Some aspects of the sanitary shield 100 can comprise additional folding fasteners 135 for improving the security of the sanitary shield 100 in the folded configuration.

A final step in folding the sanitary shield 100 can comprise pivoting each of the first and second lower center panels 115*a,b* (shown in FIG. 9) towards the lower inner surface 210 of the lower shield 105 at the first and second lower center bend lines 325*a,b*, respectively. Generally, the lower outer surface 212 of the lower shield 105 at the first lower sidewall 120 can confront the lower outer surface 212 at the second lower sidewall 130, and in some aspects, the first lower sidewall 120 can lie against the second lower sidewall 130. The folding fastener(s) 135 of the first lower sidewall 120 can engage the folding fastener(s) 135 of the second lower sidewall 130 to secure the sanitary shield 100 in the folded configuration. Thus, the sanitary shield 100 can rest on the support surface 180 (shown in FIG. 1) or can be transported without inadvertently unfolding to the unfolded configuration. FIG. 12 illustrates the sanitary shield 100 in the folded configuration, according to an example aspect of the present disclosure. As shown, the length L and height H of the sanitary shield 100 can be reduced in the folded configuration, such that the sanitary shield 100 can be easily carried by hand or placed in a backpack, a purse, or the like.

As such, a method of folding the sanitary shield 100 can comprise providing the sanitary shield 100 comprising the lower shield 105 and the upper shield 145 coupled to the lower shield 105, wherein the lower shield 105 can comprise the lower center wall 110, the first lower sidewall 120, and the second lower sidewall 130. The method can further comprise folding the folding portion 385 of the upper shield 145 relative to the lower shield 105 at the lateral fold line 370 of the upper shield 145, folding the first lower sidewall 120 relative to the lower center wall 110, and folding the second lower sidewall 130 relative to the lower center wall 110 to orient the sanitary shield 100 in the folded configuration.

In some aspects, the step of folding the folding portion 385 of the upper shield 145 relative to the lower shield 105 at the lateral fold line 370 can comprise folding the folding portion 385 over the upper end 132 of the lower shield 105 and laying the folding portion 385 substantially flat against the lower shield 105. Furthermore, in some aspects, the lower center wall 110 can comprise the first lower center panel 115*a* and the second lower center panel 115*b*, and the method can further comprise folding the first lower center panel 115*a* relative to the second lower center panel 115*b*. Example aspects of the method can further comprise folding the first lower flap 220 of the lower shield 105 relative to the first lower sidewall 120 and folding the second lower flap 230 of the lower shield 105 relative to the second lower sidewall 130. Some example aspects of the method can further comprising securing the sanitary shield 100 in the folded configuration with the one or more folding fasteners 135.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A foldable sanitary shield comprising:

a lower shield comprising a lower center wall, a first lower sidewall hingedly connected to the lower center wall, and a second lower sidewall hingedly connected to the lower center wall; and an upper shield coupled to the lower shield by an adhesive strip affixing the upper shield to the lower shield, the upper shield comprising an upper center wall, a first upper sidewall movably coupled to the upper center wall, and a second upper sidewall movably coupled to the upper center wall, wherein the foldable sanitary shield is configurable in a folded configuration and an unfolded configuration, and wherein the lower shield and the upper shield define a shielded space in an upright and in-use configuration;

wherein:

the lower shield further comprises a first lower flap hingedly connected to the first lower sidewall distal to the lower center wall and a second lower flap hingedly connected to the second lower sidewall distal to the lower center wall;

in the upright and in-use configuration, the first lower flap extends outward and away from the first lower sidewall and the second lower flap extends outward and away from the second lower sidewall to further define the shielded space;

the upper shield extends along the lower center wall and at least partially along the first lower sidewall and the second lower sidewall, but does not extend along the first lower flap or the second lower flap;

wherein the upper shield comprises a lateral fold line, wherein the lateral fold line defines at least one slit and at least one hole formed along the lateral fold line;

wherein at least one lower cut-out is formed in a lower end of the lower shield;

wherein the upper shield is affixed to the lower shield by the adhesive strip that is exposed by removing a backing;

wherein an attachment indicator is arranged on the lower shield to indicate where to affix the upper shield to the lower shield;

wherein the attachment indicator further comprises a start location and a finish location indicating where the adhesive strip starts and finishes;

wherein the upper shield is transparent; and wherein the lower shield is opaque.

2. The foldable sanitary shield of claim 1, wherein:

the upper shield defines a coupling portion and a folding portion;

the coupling portion is attached to the lower shield; and the folding portion is configured to fold relative to the coupling portion at the lateral fold line; and the folding portion lies against the lower shield in the folded configuration.

3. The foldable sanitary shield of claim 1, wherein:

the first lower sidewall is hingedly connected to a first side of the lower center wall at a first lower bend line; and the second lower sidewall is hingedly connected to a second side of the lower center wall at second lower bend line.

4. The foldable sanitary shield of claim 1, wherein:

the lower center wall defines a lower spine, a first lower center panel hingedly connected to the lower spine at a first lower center bend line, and a second lower center panel hingedly connected to the lower spine at a second lower center bend line; and the upper center wall defines an upper spine, a first upper center section movably connected to the upper spine at a first upper bend line, and a second upper center section movably coupled to the upper spine at a second upper center bend line.

5. The foldable sanitary shield of claim 1, wherein the foldable sanitary shield defines a length and a height, and wherein each the length and the height are greater in the unfolded configuration than in the folded configuration.

6. The foldable sanitary shield of claim 1, further comprising a folding fastener configured to secure the foldable sanitary shield in the folded configuration.

* * * * *